US010151467B2

(12) United States Patent
Xu et al.

(10) Patent No.: US 10,151,467 B2
(45) Date of Patent: Dec. 11, 2018

(54) INTERCONNECTION MECHANISM FOR LED BAR LIGHTING

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Bozhang Xu, Zhejiang (CN); Zhiming Wang, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 13 days.

(21) Appl. No.: 15/629,861

(22) Filed: Jun. 22, 2017

(65) Prior Publication Data

US 2017/0370568 A1 Dec. 28, 2017

(30) Foreign Application Priority Data

Jun. 22, 2016 (CN) ..... 2016 1 0452130

(51) Int. Cl.

| | |
|---|---|
| ***H01R 33/09*** | (2006.01) |
| ***F21V 23/06*** | (2006.01) |
| ***H01R 13/627*** | (2006.01) |
| ***H01R 24/38*** | (2011.01) |
| ***F21S 4/28*** | (2016.01) |
| ***H01R 13/622*** | (2006.01) |
| ***H01R 13/631*** | (2006.01) |
| ***H01R 24/28*** | (2011.01) |
| *H01R 13/64* | (2006.01) |
| *H01R 33/76* | (2006.01) |

(Continued)

(52) U.S. Cl.

CPC ..... *F21V 23/06* (2013.01); *F21S 4/28* (2016.01); *H01R 13/622* (2013.01); *H01R 13/6277* (2013.01); *H01R 13/631* (2013.01); *H01R 24/28* (2013.01); *H01R 24/38* (2013.01); *F21Y 2115/10* (2016.08); *H01R 13/04* (2013.01); *H01R 13/10* (2013.01); *H01R 13/64* (2013.01); *H01R 33/0854* (2013.01); *H01R 33/09* (2013.01); *H01R 33/7692* (2013.01); *H01R 2101/00* (2013.01); *H05B 33/0803* (2013.01)

(58) Field of Classification Search

CPC .... H01R 33/09; H01R 13/64; H01R 33/0854; H01R 33/7692

USPC ..... 439/734, 375, 680

See application file for complete search history.

(56) References Cited

U.S. PATENT DOCUMENTS 3,470,524 A * 9/1969 Culver ..... H01R 13/623 24/573.11

4,801,277 A * 1/1989 Seilhan ..... H01R 13/64 439/597

* cited by examiner

*Primary Examiner* — Abdullah Riyami
*Assistant Examiner* — Justin Kratt
(74) *Attorney, Agent, or Firm* — Wang Law Firm, Inc.

(57) ABSTRACT

An interconnection mechanism for LED bar lighting includes a plug mechanism and a socket mechanism. The plug mechanism includes a hollow socket, a plug, and a connection pin. The hollow socket includes a hollow plug barrel, a stop ring, a wedge importing ring, and at least one opening. A slope of the wedge importing ring extends toward a free end of the hollow plug barrel. The connection pin includes at least one plug locating ring, at least one socket locating ring, and at least one socket locating bar. The plug locating ring is arranged between the stop ring and the wedge importing ring for fixing the relative position of the connection pin and the hollow socket. The socket mechanism includes a hollow socket barrel, and a locating slot. The socket locating bar is engaged with the locating slot so as to fix the relative position of the connection pin and the hollow socket barrel.

9 Claims, 3 Drawing Sheets

(51) Int. Cl.

| | |
|---|---|
| *H01R 33/08* | (2006.01) |
| *H01R 13/04* | (2006.01) |
| *H01R 13/10* | (2006.01) |
| *H01R 101/00* | (2006.01) |
| *H05B 33/08* | (2006.01) |
| *F21Y 115/10* | (2016.01) |

INTERCONNECTION MECHANISM FOR LED BAR LIGHTING

RELATED APPLICATION

This present application claims benefit of the Chinese Application, CN 201610452130.8, filed on Jun. 22, 2016.

BACKGROUND

1. Technical Field

The present application relates to a lighting device, and more particularly to an interconnection mechanism for LED bar lighting.

2. Description of the Related Art

As lighting technology in the field of energy conservation and environmental protection applications continues to develop, LED lighting obtains a rapid application due to energy consumption, high luminous efficiency and wide application advantages. With the continuous improvement of quality of life, the demands for home lighting and commercial lighting are also increasing accordingly. When the lighting space range is adjusted, it is also need to adjust lighting range of lamps. Especially, in commercial lighting applications, such as exhibition cabinets, the desired range of lighting is determined by the number of the exhibition cabinets. Therefore, it need to quickly and easily adjust the lighting range by interconnecting a plurality of LED bar lights which have a certain length.

The LED bar lightings in the art generally adopt plug and socket to achieve interconnection. However, it is difficult to ensure a stable connection effect by simply inserting the plug directly into the receptacle of the socket. Generally, the receptacle of the socket can only restrict the movable space of the plug in a radial direction of the LED bar lighting, but in an axial direction of the LED bar lighting, the socket and the plug have poor limit effect. Therefore, the interconnection stability of the LED bar lighting is poor, and it is difficult to achieve a stable electrical connection, which affects the practical use.

Therefore, it is necessary to provide an interconnection mechanism for LED bar lighting which makes it possible to solve the above problems.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
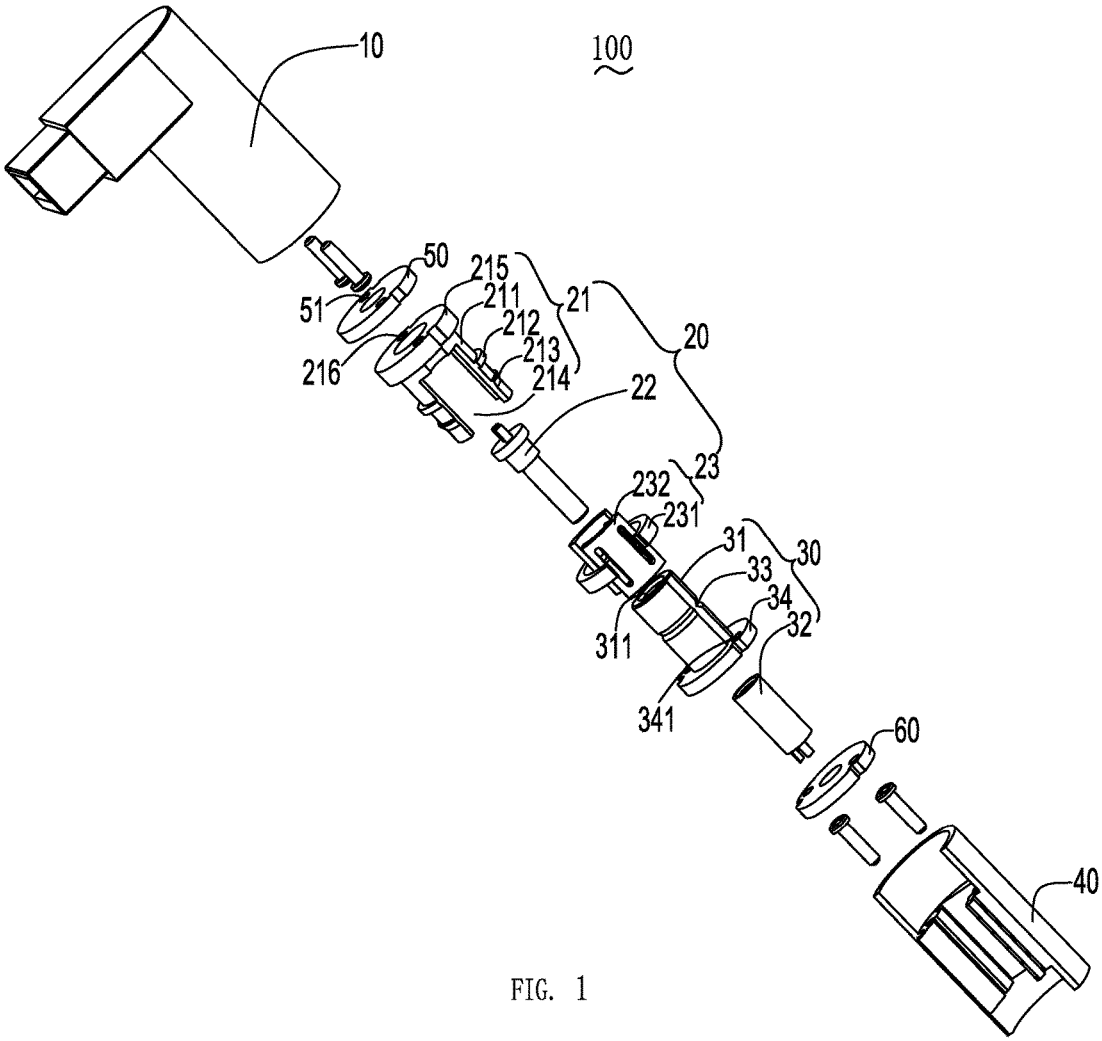
FIG. 1 is an explored view of an interconnection mechanism for LED bar lighting according to an embodiment.
Figure 2:
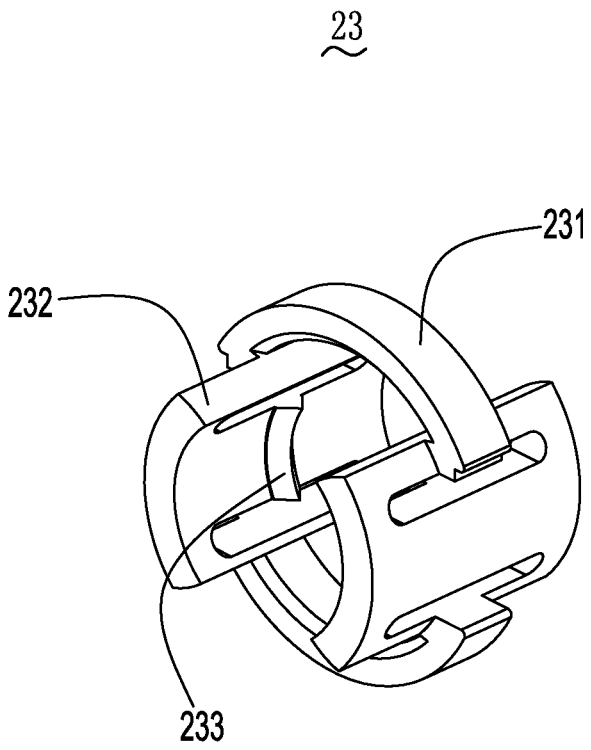
FIG. 2 is a schematic view of a connection pin of the interconnection mechanism for LED bar lighting of FIG. 1.
Figure 3:
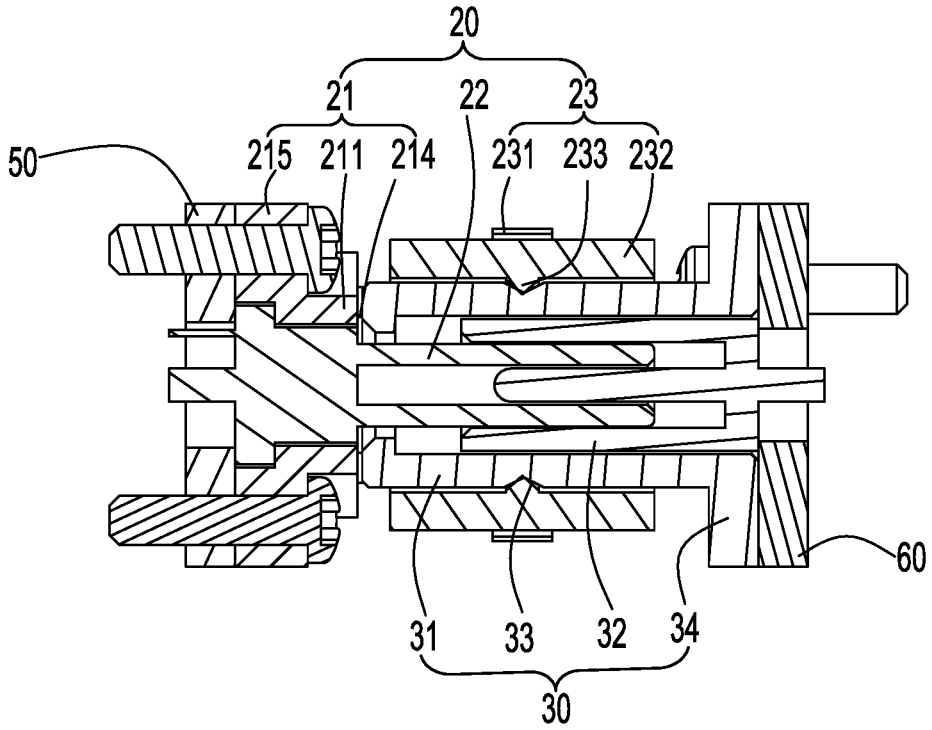
FIG. 3 is a cross sectional view of the interconnection mechanism for LED bar lighting of FIG. 1.

Referring to FIG. 1 to FIG. 2, an interconnection mechanism 100 for LED bar lighting is shown. The interconnection mechanism 100 for LED bar lighting includes a first lighting body 10, a plug mechanism 20 arranged on the first lighting body 10, a socket mechanism 30 connected to the plug mechanism 20, a second lighting body 40 for disposing the socket mechanism 30, a first limit plate 50 arranged between the first lighting body 10 and the socket mechanism 30, and a second limit plate 60 arranged between the second lighting body 40 and the socket mechanism 30. It can be understood that the LED bar lighting further includes other function modules, such as frame, wires, power supply module, light source module, and so on, which is well known for these skilled in the art, and not described in detail.

The first lighting body 10 may be a frame, or a house. The frame can be use to set up the whole lamp and configured for mounting the plug mechanism 20 or the socket mechanism 30, or the other mechanism. The house may be used to arrange the light source module, cover, and so on. In the present embodiment, the first lighting body 10 is a frame and is configured for receiving the wires, and the plug mechanism 20. It can be appreciated that each of the LED bar lighting must include at least two the first lighting body 10, which is used as the frame.

The plug mechanism 20 includes a hollow socket 21, a plug 22 received in the hollow socket 21, and a connection pin 23 disposed on the hollow socket 21. The hollow socket 21 includes a hollow plug barrel 211, a stop ring 212 arranged on an outer side wall of the hollow plug barrel 211, a wedge importing ring 213, at least one opening 214 opened on the hollow plug barrel 211, and a plug flange 215 disposed on an end of the hollow plug barrel 211. The hollow plug barrel 211 is configured for receiving the plug 22 and disposing the other parts, such as the plug flange 215, the connection pin 23, and the first limit plate 50. The stop ring 212 is provided coaxially on the outer side wall of the hollow plug barrel 211 and has a quadrangle cross section along a radial direction of the hollow plug barrel 211. The wedge importing ring 213 is spaced apart from the stop ring 212 and is configured for locating the relative position between the connection pin 23 and the hollow plug barrel 211. The wedge importing ring 213 include a slope in a cross section along an axial direction of the hollow plug barrel 211, and the slope extends toward a free end of the hollow plug barrel 211. The opening 214 is disposed on a side wall of the hollow plug barrel 211 so that the side wall of the hollow plug barrel 211 can be deformed toward the center line thereof when the connection pin 23 is pressed between the stop ring 212 and the wedge importing ring 213. As a result, the connection pin 23 can be smoothly mounted on the outer side wall of the hollow plug barrel 211 so as to avoid the connection pin 23 or the hollow socket 21 from damaging. At least two screw holes 216 are provided on the plug flange 215 and are configured for mounting screws to fix the hollow socket 21 onto the first lighting body 10 so as to assemble the plug mechanism 20 onto the first lighting body 10. The plug 22 is a hollow barrel and is assembled into the hollow plug barrel 211. In order to prevent the plug 22 from crossing over the hollow plug barrel 211, one of two ends of the plug 22 has a step. As well known for a person skilled in the art, the plug 22 further includes wires, pins, or the like. The connection pin 23 includes a plug locating ring 231, at least one socket locating ring 232 connected to the plug locating ring 231, and at least one socket locating bar 233 disposed on an inner side wall of the socket locating ring 232. The plug locating ring 231 is embedded between the stop ring 212 and the wedge importing ring 213 so as to fix the relative position of the connection pin 23 and the hollow socket 21. An inner diameter of the plug locating ring 231 is equal to that of the hollow plug barrel 211, and a chamfer 234 is provided on an inner wall of one side of the plug locating ring 231. The purpose of setting the chamfer 234 is to mate with the slope of the wedge importing ring 231 so as to smoothly press the plug locating ring 231 between the stop ring 212 and the wedge importing ring 213. While the plug locating ring 231 is pressed between the stop ring 212 and the wedge importing ring 213, the socket locating ring 232 also can be inserted into the opening 214 of the hollow socket 21. The socket locating ring 232 of the connecting pin 23 has same axial length with the hollow plug barrel 211 so that the connecting pin 23 and the hollow plug barrel 211 can be aligned with the ends thereof. The socket locating ring 232 has same configuration and inner diameter with the hollow plug barrel 211. The socket locating bar 233 is disposed on the inner side wall of the socket locating ring 232, and the setting position thereof is dependent on the structure of the socket mechanism 30, and the specific operation principle thereof will be described in detail below.

The socket mechanism 30 includes a hollow socket barrel 31, a socket 32 mounted in the hollow socket barrel 31, a locating slot 33 opened on an outer side wall of the hollow socket barrel 31, and a socket flange 34 disposed in one end of the hollow socket barrel 31. The hollow socket barrel 31 is inserted into the hollow plug barrel 211 and an outer diameter of the hollow socket barrel 31 is equal to the inner diameter of the hollow plug barrel 211 so that the locating slot 33 is engaged to the socket locating bar 233. The socket 32 is inserted into the hollow socket barrel 31. In order to avoid the socket 32 from falling off out of the hollow socket barrel 31, a flange 311 is provide on one end of the hollow socket barrel 31 and extends toward the center thereof. It is appreciated that the socket 32 has wires, holes, or the like disposed therein. The locating slot 33 is opened on the outer side wall of the hollow socket barrel 31. In a cross section perpendicular to an axial direction of the hollow socket barrel 31, the locating slot 33 has same cross-section shape with the socket locating bar 233. In order to facilitate to insert or press the socket locating bar 233 into the locating slot 33, a cross-section shape of the socket locating bar 233 and the locating slot 33 is triangle. The socket flange 34 is provided at the other end of the hollow socket barrel 31 with respect to the flange 311 and has at least two screw holes 341. The socket flange 34 is used to fix the socket mechanism 30 to a frame or a house via some screws which pass through the screw holes 341. In the present embodiment, the socket mechanism 30 is fixed on the second lighting body 40.

The second lighting body 40 has same configuration with the first lighting body 10 and may be a frame or a house. In the present embodiment, the second lighting body 40 is a house. Therefore, when the plug mechanism 20 is interconnected with the socket mechanism 30 together, the interconnection mechanism 100 can supply power for the light source module received in the second lighting body 40. In order to interconnect the first and second lighting bodies 10, 20, the two ends of the second lighting body 40 regarded as the house of the LED bar lighting are assembled the plug mechanism 20 and the socket mechanism 30.

The first limit plate 50 is mounted between the first lighting body 10 and the plug mechanism 20. Specifically, the first limit plate 50 is disposed on a free side of the plug flange 215 and is configured to limit the location of the plug 22, that is to say, the plug 22 is clamped between the first limit plate 50 and the plug flange 215 by the first limit plate 50 and the step of the plug 22 so as to fix the location of the plug 22. The first limit plate 50 has at least two first screw holes 51 provided thereon and is fixed to the first lighting body 10 by the same screw.

The second limit plate 60 has same function with the first limit plate 50, and is mounted on a free side of the socket flange 34 and is used to fix the location of the socket 32. That is to say, the socket 32 is clamped between the hollow socket barrel 31 and the second limit plate 60 by the second limit plate 60 and the flange 311 of the hollow socket barrel 31 so as to fix the location of the socket 32. As a result, when the plug mechanism 20 is inserted into the socket mechanism 30, it is possible to prevent the bad electrical connection in which is resulted by the change in the position of the plug 22 and the socket 32.

As described above, since the interconnection mechanism 100 of LED bar lighting has the plug mechanism 20 and the socket mechanism 30, the relative position along the radial direction of the first and second lighting bodies 10, 40 is fixed by the cooperation of the hollow plug barrel 211 and the hollow socket barrel 21 along the radial direction thereof. And, the relative position along the axial direction of the first and second lighting bodies 10, 40 is fixed by the engagement of the socket locating bar 233 of the connection pin 23 and the locating slot 33. As a result, it is possible to fix the relative position of the first and second lighting bodies 10, 40 in all directions so that the location of the interconnection of the first and second lighting bodies 10, 40 are not deformed.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An interconnection mechanism for LED bar lighting, comprising:

a plug mechanism, the plug mechanism comprising a hollow socket, a plug received in the hollow socket, and a connection pin disposed on the hollow socket, the hollow socket comprising a hollow plug barrel, a stop ring disposed on an outer side wall of the hollow plug barrel, a wedge importing ring disposed on the outer side wall of the hollow plug barrel and spaced apart from the stop ring, and at least one opening opened on the hollow plug barrel, a slope of the wedge importing ring extending toward a free end of the hollow plug barrel, the connection pin comprising at least one plug locating ring, at least one socket locating ring connected to the plug locating ring, and at least one socket locating bar disposed on an inner side wall of the socket locating ring, the plug locating ring being arranged between the stop ring and the wedge importing ring for fixing the relative position of the connection pin and the hollow socket, an inner diameter of the socket locating ring being equal to that of the hollow plug barrel; and a socket mechanism, the socket mechanism comprising a hollow socket barrel, and a locating slot provided on the hollow socket barrel, an outer diameter of the hollow socket barrel being equal to an inner diameter of the hollow plug barrel, the socket locating bar being engaged with the locating slot so as to fix the relative position of the connection pin and the hollow socket barrel.

2. The interconnection mechanism for LED bar lighting as claimed in claim 1, wherein a cross-section shape of the socket locating bar is triangle, a cross-section shape of the locating slot is triangle.

3. The interconnection mechanism for LED bar lighting as claimed in claim 1, wherein a chamfer is provided an inner wall of one side of the plug locating ring.

4. The interconnection mechanism for LED bar lighting as claimed in claim 1, wherein an inner diameter of the plug locating ring is equal to an outer diameter of the hollow plug barrel.

5. The interconnection mechanism for LED bar lighting as claimed in claim 1, wherein the hollow socket further comprises a plug flange disposed on one end of the hollow plug barrel, at least two screw holes are provided on the plug flange.

6. The interconnection mechanism for LED bar lighting as claimed in claim 5, wherein the interconnection mechanism further comprises a first limit plate, the first limit plate is disposed on a free side of the plug flange.

7. The interconnection mechanism for LED bar lighting as claimed in claim 1, wherein the socket mechanism further comprises a socket flange disposed on one end of the hollow socket barrel, at least two screw holes are provided on the socket flange.

8. The interconnection mechanism for LED bar lighting as claimed in claim 7, wherein the interconnection mechanism further comprises a second limit plate, the second limit plate is mounted on a free side of the socket flange.

9. The interconnection mechanism for LED bar lighting as claimed in claim 1, wherein the socket locating ring of the connection pin has same axial length with the opening of the hollow plug barrel.

* * * * *